United States Patent [19]

Teed et al.

[11] 4,369,622

[45] Jan. 25, 1983

[54] METHOD AND APPARATUS FOR DRAWING AND BLENDING TEXTILE MATERIALS

[75] Inventors: Richard K. Teed, Greenwood; Arther M. Pressley, Ware Shoals, both of S.C.

[73] Assignee: Riegel Textile Corporation, Ware Shoals, S.C.

[21] Appl. No.: 132,785

[22] Filed: Mar. 24, 1980

[51] Int. Cl.[3] ..... D01G 1/06; D01G 13/00; D01H 5/00

[52] U.S. Cl. ..... 57/315; 19/243; 19/145.5; 57/2; 57/90; 57/901; 242/132

[58] Field of Search ..... 19/243, 258, 287–292, 19/145.5; 57/315, 2, 90, 91, 12, 901; 242/128, 132, 137, 138

[56] References Cited

U.S. PATENT DOCUMENTS

| | | | |
|---|---|---|---|
| 413,994 | 10/1889 | Wood | 242/132 |
| 1,099,766 | 6/1914 | Prince | 242/137 |
| 3,092,953 | 6/1963 | Blackstock | 57/315 X |
| 3,670,485 | 6/1972 | Brown et al. | 19/145.5 X |
| 3,678,675 | 7/1972 | Klein | 57/901 X |
| 3,703,073 | 11/1972 | Goodbar et al. | 57/315 X |
| 3,828,543 | 8/1974 | Goodbar et al. | 57/901 X |
| 3,987,613 | 10/1976 | Woods et al. | 57/901 X |

OTHER PUBLICATIONS

Article: "Metal Fibers" *Modern Textile Magazine* by Harold H. Webber, pp. 72–75, May, 1966.

Article: "Textile Applications of Metal Fibers" *Modern Textile Magazine* by Gerald F. Barry, pp. 53–56, Jun., 1967.

*Primary Examiner*—John Petrakes

*Attorney, Agent, or Firm*—Pennie & Edmonds

[57] ABSTRACT

A method is disclosed for drawing and blending textile fiber and conductive metal filaments. The method is characterized by feeding at least one bundle of a first textile material through draw rollers of a drawing frame, unwinding at least one roll of a bundle of second material in the form of conductive fibers adjacent the first pair of rollers of the drawing frame, feeding the conductive fiber bundle into the back rollers of the drawing frame simultaneously with the textile material fiber bundle, and guiding the textile material fiber bundle and the conductive fiber bundle relative to each other such that the latter continuously cushions the textile material fiber bundle with respect to the draw rollers when passing therethrough. The conductive fibers are preferably in the form of at least one bundle of staple length fiber sliver rolled about a spool which is supported on a support apparatus positioned behind the back rollers of the drawing frame a distance approximately equal to, and preferably less than the average length of the metal fiber staples to insure continuous gripping of the metal fiber bundle by the back rollers of the drawing frame. An apparatus for practicing the method is also disclosed.

18 Claims, 8 Drawing Figures

METHOD AND APPARATUS FOR DRAWING AND BLENDING TEXTILE MATERIALS

TECHNICAL FIELD

The present invention relates to an improved method and apparatus for anti-static yarn production which is characterized by supporting and positioning of a spool of a bundle of conductive fibers prior to introduction into the drawing rollers of a drawing frame such that the spool movement is coaxial to the rotation of the drawing rollers.

BACKGROUND ART

Yarns have been developed which when woven or knitted into cloths are capable of preventing or dissipating electrostatic charges. Generally these yarns have been developed in response to the need for fabrics which are capable of dissipating or eliminating sparks either substantially or completely. Electrostatic discharges may result from many causes including the use of electronic equipment, interfabric friction, etc. It is particularly important, for example, to prevent discharge of electrical sparks in hospital operating rooms in which oxygen and the administration of highly flammable materials, such as anesthetic gases are almost always present. Electronic equipment is particularly susceptible to the introduction of error signals due to the presence of static discharge. Other obvious examples of the situations which should be kept free from static discharge through sparking are grain elevators, areas where explosives and fuel are stored or handles, etc. Thus, it will be appreciated that the needs for antistatic fabrics are legion.

One approach to the production of antistatic yarn and fabrics has been directed to blending textile material fibers with conductive metal fibers at the fiber drawing stage to produce a blend of the material fibers. In particular, it has been found to be desirable to produce a uniform and homogenous yarn and fabric in order to satisfy spark dissipation requirements. Moreover, it has been found that when the metal or other conductive fibers are dispersed uniformly throughout the yarn and fabric, the conductive fibers become entrapped within the textile fibers. When the conductive fibers are so uniformly dispersed, the fabric assumes a uniform appearance which is pleasing to the eye. Without such uniform distribution of the conductive fibers, the conductive fibers tend to cluster into small groups (or slubs) usually near the outer surface of the yarn. Where conductive fibers are of stainless steel or carbon materials, the slubs appear as numerous grey or black streaks in the finished fabric. Such slubbing problems were sought to be overcome by the invention disclosed in commonly assigned U.S. Pat. Nos. 3,703,073 and 3,828,543 to Goodbar et al, the disclosures of which are incorporated herein by reference.

The Goodbar et al. U.S. Pat. No. 3,703,073 relates to a method and apparatus for drawing a combination yarn consisting of textile fiber and metallic filaments. Broadly, the method comprises the simultaneous drawing of a textile fiber bundle and a multifilament metal bundle while guiding the metal bundle relative to the textile bundle to cause the latter continuously to cushion the metal bundle while controlling the tension forces upon the bundle of filaments such that a gradual breaking of filaments occurs. The broken filaments are distributed uniformly throughout the finished textile yarn. More specifically, the method employs feeding a textile fiber sliver into a first set of draw rolls while simultaneously feeding a metal multifilament bundle thereto which is guided into a continuous contact with the textile fiber bundle while controlling the tension forces thereon. The Goodbar et al. U.S. Pat. No. 3,828,543 is a divisional of the patent application from which the '073 patent issued and relates the antistatic yarn produced according to the method, and on the apparatus of the '073 patent.

In the Goodbar et al. patents, the metal fiber bundle is preferably in the form of a bundle of continuous multifilament stainless steel fibers in the form of a tow and includes a spool and purn arrangement wherein the spool is subjected to a rotational drag by applying tension on a strap and the continuous filament stainless steel tows are dispersed while under such tension.

Although the inventions of the Goodbar et al. patents successfully solved the problems theretofore existing in the production of such yarns and fabrics, later refinements of the invention were necessarily made which paved the way for further inventive contribution.

For example, more recently it became apparent that staple length stainless steel fibers in the form of a stainless steel "sliver" (as opposed to "tow") may be blended with textile fibers with perhaps, less difficulties and greater uniformity and homogeniety, particularly because of the effectively "pre-broken" character of the metal fibers. An example of such conductive fiber sliver is BEKINOX brand stainless steel multifiber "staple length" sliver marketed by Bekaert S. A., a Belgian corporation, in the form of rolls of bundles of staple length stainless steel fibers. When such staple length fibers were blended in the prior art system as disclosed in the Goodbar et al. patent, however, it was found that the staple length fibers, being discontinuous, were torn apart due to the tension applied, particularly between the location of unwinding from the spool and the point of entry into the back rolls of the apparatus, a distance usually greater than the length of the stainless steel staples. This resulted in a disruption of the operation and excessive waste of stainless steel sliver material. In addition, because the stainless steel sliver is wound on the spool progressively from left to right with respect to the axis of the spool and vice-versa, when it became unwound on the apparatus, when on the upright spindle of the prior art devices, the sliver bundle assumed an upward and downward movement which caused frictional contact and fraying between the portion of sliver being unwound and the surface of the portion of sliver which was still wound on the spool.

We have invented a method and apparatus which not only avoids the above-noted disadvantages of the prior art, but which may be utilized with conductive filament tows, metal or otherwise, either in the form of continuous multifilament bundles or staple length sliver bundles with the result that improved yarns and fabrics are produced.

DISCLOSURE OF THE INVENTION

The invention relates to a method of drawing and blending at least two bundles of fibrous materials while maintaining contact with each other comprising feeding at least one bundle of a first fibrous material through draw rollers of a drawing frame, unwinding a roll of a bundle of second fibrous material adjacent the back rollers of the drawing frame, feeding the second fibrous material bundle into the back rollers of the drawing frame simultaneously with said first fibrous material bundle, and guiding said first fibrous material bundle and the second fibrous material bundle relative to each other such that the latter is continuously cushioned by the first material bundle with respect to the draw rolls when passing therethrough.

In a preferred form the invention relates to a method of drawing and blending textile fiber and conductive fibers while maintaining contact with each other comprising feeding at least one bundle of fibers of a first textile material through draw rolls of a drawing frame, unwinding at least one roll of a bundle of second material in the form of conductive fibers adjacent the back rollers of the drawing frame, feeding the conductive fiber bundle into the back rollers of the drawing frame simultaneously with said textile material fiber bundle, and guiding said textile material fiber bundle and the conductive fiber bundle relative to each other such that the latter is continuously cushion by the textile material fiber bundle with respect to the draw rolls when passing therethrough.

In particular, the method is preferably practiced by feeding at least one bundle of textile material and at least one bundle of conductive fibers into a plurality of successive sets of draw rolls of a drawing frame and the metal fiber bundle is guided precisely into the first (or back) set of rolls of the drawing frame. A spool of the conductive metal fibers is supported for unwinding in a support means which comprises a significant aspect of the present invention.

According to another preferred arrangement of the invention, the draw rollers are arranged horizontally, and a plurality of textile fiber bundles and metal fiber bundles are fed to the rolls, the textile bundles being guided substantially immediately adjacent the first set of rollers in side-by-side relationship. Each of the metal bundles overlie one of the textile bundles. The method may also be practiced wherein the textile fiber bundles and metal fiber bundles have similar surface friction characteristics with respect to the draw rolls or wherein the textile fiber bundle is cotton and the metal fiber bundle is stainless steel fibers, preferably, in the 4 to 12 diameter micron range. After drawing, the combined fibers are in the form of fibrous slivers which may be redrawn as many times as is required to obtain the desired blend attenuation and uniformity. Thereafter, the final sliver product is subjected to roving and spinning steps to create yarn and the yarn is woven, knitted, etc. to form a fabric.

In the event greater percentages of conductive fibers are required, the method may be practiced by unwinding two or more rolls of conductive fibers behind the first set of rolls, the spool of which may be supported either on a single spool support device constructed according to the apparatus of the invention, or multiple support devices positioned in adjacent end-to-end relation, as needed. Alternately an elongated spool support device may be arranged to support multiple spools in end-to-end adjacent relation.

The spool support arrangement of the present invention obviates the need for an upright spindle support and tensionsing purn as utilized in the prior art. It has been found that the drag between the spool support and the spool itself is sufficient to supply the requisite tension for metallic fiber bundle material. Moreover, the present invention is capable of utilizing staple-length (or non-continuous) metallic material fibers without developing a fraying problem as prevalent in prior art devices.

Other advantages flow from the utilization of the present invention. Textile yarn material produced according to the present invention may contain any required percentage by fabric weight of stainless steel fibers including 1% or less and up to 25% or more.

In addition, although the method of the present invention contemplates the production of antistatic fabrics for use in hospital operating rooms containing up to approximately 2% by weight of stainless steel fibers any two fibrous materials can be blended according to the invention for various uses, such as blending cotton and polyester fibers for commercial fabrics, or the like. Furthermore, recently it has been noted that blends of textile and stainless steel fibers containing greater percentages of stainless steel fibers may be utilized for radar deflecting camouflage fabrics or fabrics for other related and non-related uses.

The invention also pertains to the yarn product made according to the method of the invention, as well as the fabric constructed from the yarn, either knitted, woven, or otherwise assembled.

The invention also relates to an apparatus for supporting at least one spool of a bundle of textile fibrous material for introduction into a textile operation comprising a support container having a generally arcuate cross-sectional configuration for nestled reception of the spool therein so as to permit continuous unwinding of the bundle of fibrous material when tension is applied thereto, means for guiding the bundle of fibrous material adjacent the container so as to guide the fibrous material in a predetermined direction after unwinding from the spool.

In the preferred arrangement, the invention contemplates an apparatus for supporting at least one spool of a bundle of staple length metal fibers and for permitting unwinding of the bundle of metal fibers for introduction into a drawing frame for blending therein with textile material fibers comprising a support container having a generally arcuate cross-sectional configuration sufficiently similar to the cross-section of the support ends of the spool for nestled reception of the spool of metal fibers therein so as to permit continuous unwinding of the bundle of metal fibers when it is continuously drawn into the back rollers of the drawing frame, means secured to said support container for guiding the bundle of metal fibers in a predetermined direction substantially immediately after unwinding from the spool and in a manner to cause the metal fibers and textile fibers to be brought initially in contact with each other without twisting of said textile bundle immediately prior to passing through the back rollers of the drawing frame, switching means to detect the tension forces applied to the fiber bundle when the bundle is drawn into the drawing frame and to deactivate the drawing process in the event the bundle of filaments is broken.

The invention also relates to an apparatus for simultaneous drawing of bundles of textile fiber and metal fibers comprising a frame, at least a first and second pair of draw rollers mounted on the frame for rotation, means for supporting at least one spool of a bundle of staple length metal fibers and for permitting unwinding of said bundle of metal fibers rolled thereabout for introduction into the draw rollers for blending therein with textile material fibers, said supporting means comprising a support container having a generally arcuate cross-sectional configuration sufficiently similar to the cross-sections of the support ends of the spool for nestled reception of the spool of metal fibers therein so as to permit continuous unwinding of the bundle of metal fibers when it is continuously drawn into the first pair of rollers of the drawing frame, means for guiding the textile fiber bundles into said draw rollers, means adjacent said support container for guiding the bundle of metal fibers in a predetermined direction relative to the textile fiber bundles and in a manner to cause the metal fibers and textile fibers to be brought initially in contact with each other without twisting of the textile bundle immediately prior to passing through the first pair of rollers of the drawing frame, switching means to detect the tension forces applied to the metal fiber bundle when the bundle is drawn into the drawing frame and to deactivate the drawing process in the event the bundle of filaments is broken.

Preferably, the basic drawing frame is an IDEAL brand drawing frame modified as described herein. The basic IDEAL brand drawing frame is marketed by IDEAL INDUSTRIES, INC. and includes four pairs of gear tooth type rollers as described herein. Other drawing frames, however, may also be utilized in practicing the instant invention.

It has been found that the inner arcuate surface of the spool supporting container nestles the spool of metal fiber bundle therein while providing sufficient controlled rotational resistance so as to facilitate the application of tension to the metal fibers when they are drawn into the first pair of rollers of the drawing frame. Hence, since the tension of the metal fibers is also controlled between each successive pair of drawing rollers, the tension on the bundle of staple length (or continuous filament, as the case may be) fibers is thus controlled throughout the drawing process. Furthermore, control of the tension force between the spool of metal fibers and the first pair of rollers may be altered as needed by adjusting the smoothness of the inner arcuate surface of the spool supporting container either by polishing the surface to reduce tension for example, or by roughening the surface to increase rotational resistance on the spool, and hence, the metal fiber tension, for example.

The invention also relates to the finished yarn product produced on the apparatus of the invention, as well as the fabric constructed from the yarn, either knitted, woven, or otherwise assembled.

BEST MODE FOR CARRYING OUT THE INVENTION

In the following description, the terms "upwardly", "downwardly", "above", and "beneath" are used for descriptive purposes only. It should be understood that they are not intended to limit the invention or use thereof to any particular orientation or position.

Figure 1:
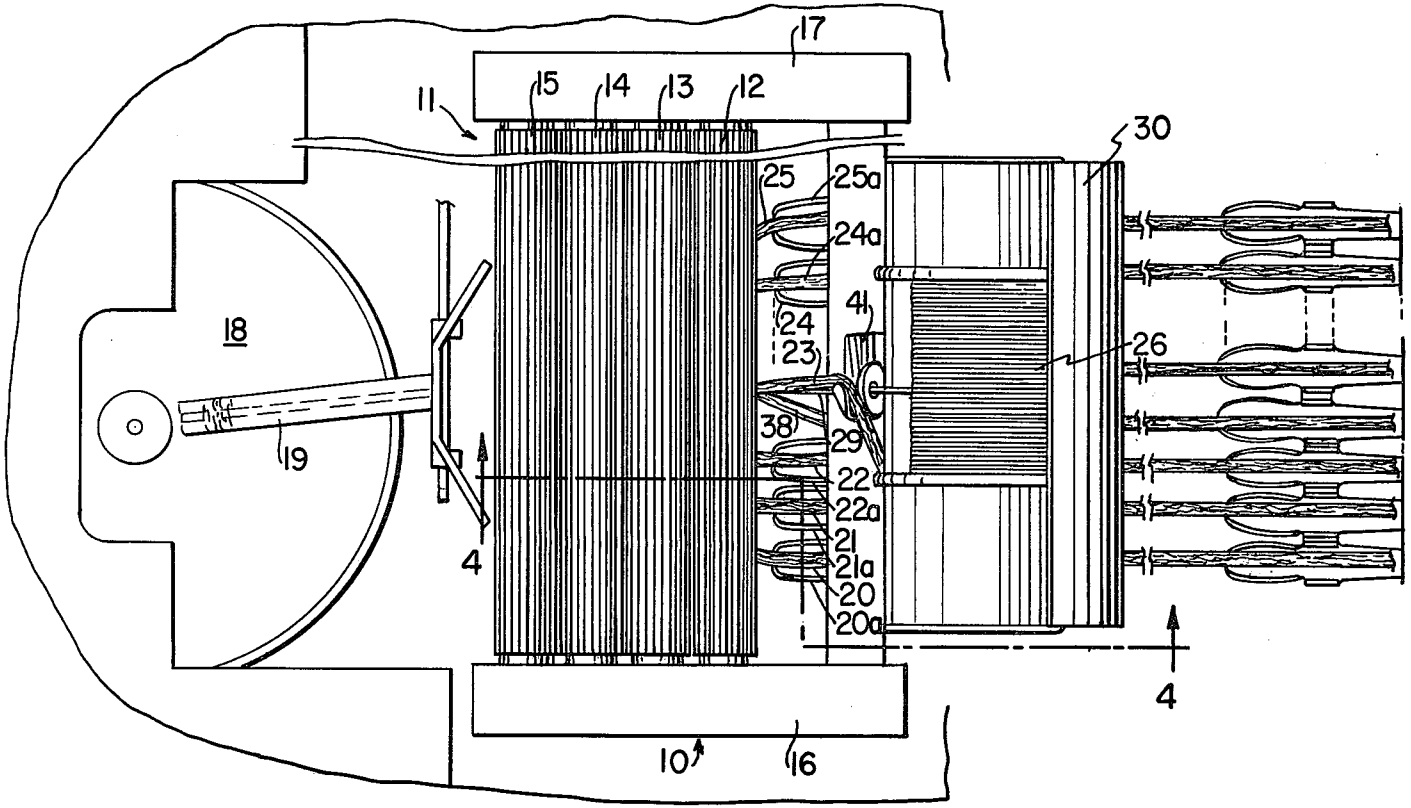
FIG. 1 illustrates in plan view, partially cut away, of the apparatus of the method invention for carrying out the method of the present invention.

Referring initially to FIG. 1 of the drawings, a drawing frame 10 modified in accordance with the principles of the present invention has been illustrated. As shown in FIG. 1, the drawing frame 10 includes sets of four pairs of draw rollers 11 comprising individual rollers 12 through 15. These are journalled in bearings for rotation in frame members 16 and 17. Rollers 12 through 15 are rotatably driven in the conventional manner (by means not shown). Rollers 13 are driven slightly faster than rollers 12, rollers 14 faster than 13, and so on to attenuate the meshing textile sliver as it passes through the sets of rollers. Furthermore, as is conventional, rollers 13 will have a greater number of teeth than rollers 12, 14 a greater number than 13, and rollers 15 will have the greatest number of teeth. The separation on centers, for example, between rollers 12 and 13 in a particular embodiment would be $1\frac{7}{8}$ inch, $1\frac{3}{4}$ inch will separate rollers 13 and 14, and $1\frac{5}{8}$ inch will separate rollers 14 and 15. After passing through sets of rollers 11, the several slivers, as will be described, are gathered and enter bin 18 through tube 19. At this point, the respective meshed slivers include those having metal microfilaments that have been mixed or blended into a single sliver. Another successive drawing or drawings will then follow until fiber attenuation, orientation, and further mixing or blending is completed.

Figure 2:
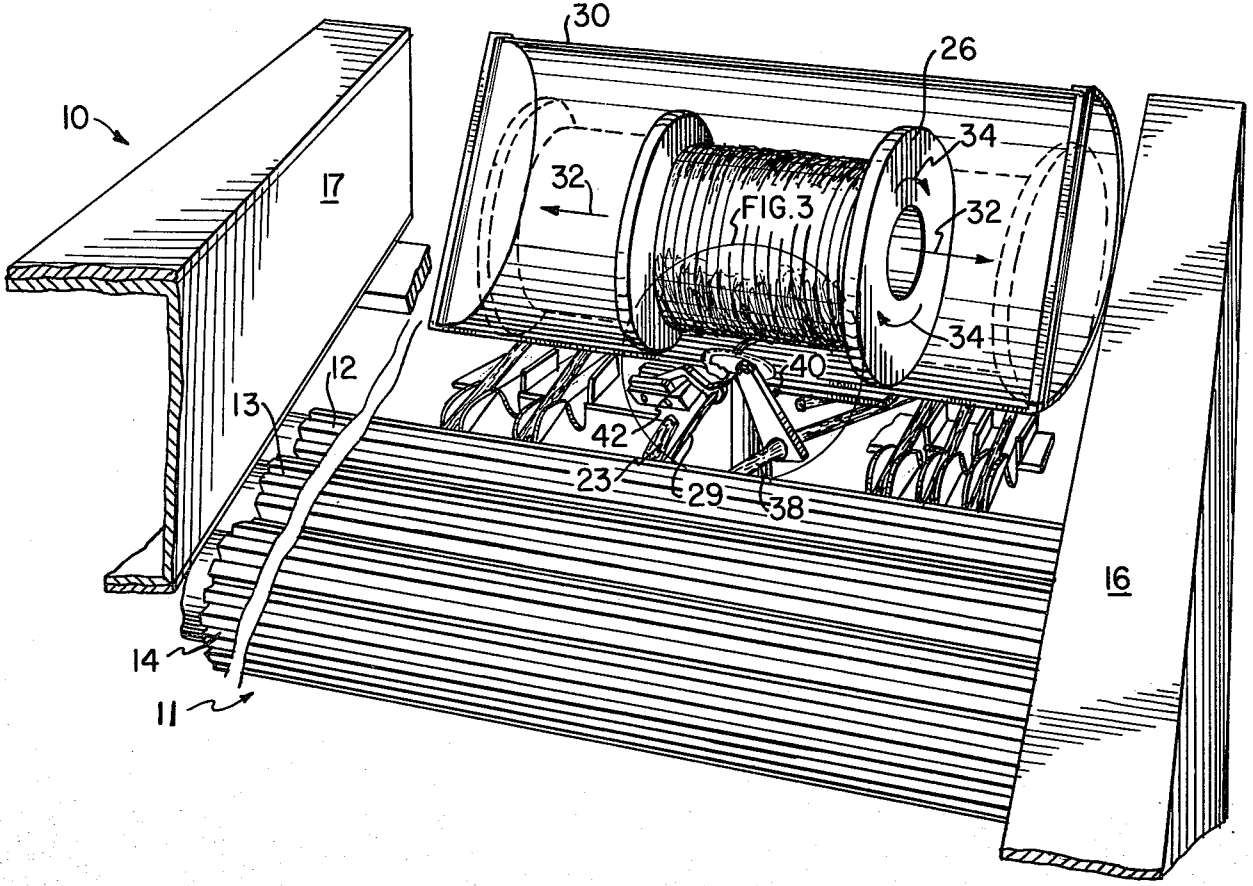
FIG. 2 is a perspective view of the spool arrangement of the apparatus of FIG. 1.

As illustrated in FIG. 2, the spool 26 is nestled within spool support 30 and unwinds the metal fibrous bundle 29 adjacent the drawing frame's first set (i.e. back) of rollers 12. The rotational axis of the spool 26 is shown to be parallel to the rotational axes of the drawing rollers as illustrated by arrows 34. Furthermore, the spool 26 has a lateral motion 32 which causes it to shift leftwardly and rightwardly within its support 30 which results as the metal fiber bundle is drawn into the draw rollers causing the spool to unwind. Spool support 30 and its support bracketry are preferably of sturdy metal construction as shown.

Figure 3:
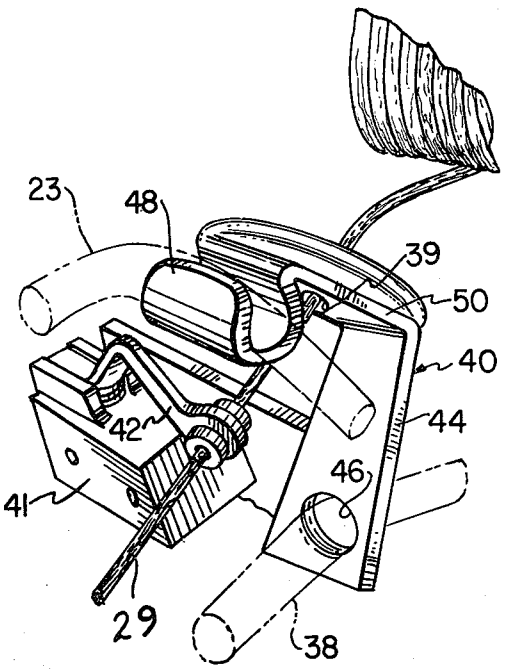
FIG. 3 is an enlarged perspective view of the guides for guiding both the textile fiber bundle and the bundle of conductive metal fiber material.

An enlarged perspective view of the fiber guide 40 by which the metal fiber bundle 29 is guided to be meshed and cushioned between the drawing rollers 11 is shown in FIG. 3. Preferably, the metal fiber bundle 29 unwinds in a relative motion off the spool through an opening 39 in the angular plate 50 which is part of the sliver guide 40. The fiber bundle then passes through a movable guiding sleeve 42. The sleeve is movable and is part of switch 41 which activates and deactivates power to the rollers 12 to 15 so as to cut off power when sliver 29 breaks due to excessive tension.

The sliver guide 40 also positions the textile fiber bundles 23 and 38 such that at the engaging points of the drawing rollers 11 the metal fibers of bundle 29 are supported from both above and beneath by textile fibers.

Figures 4, 5, 6:
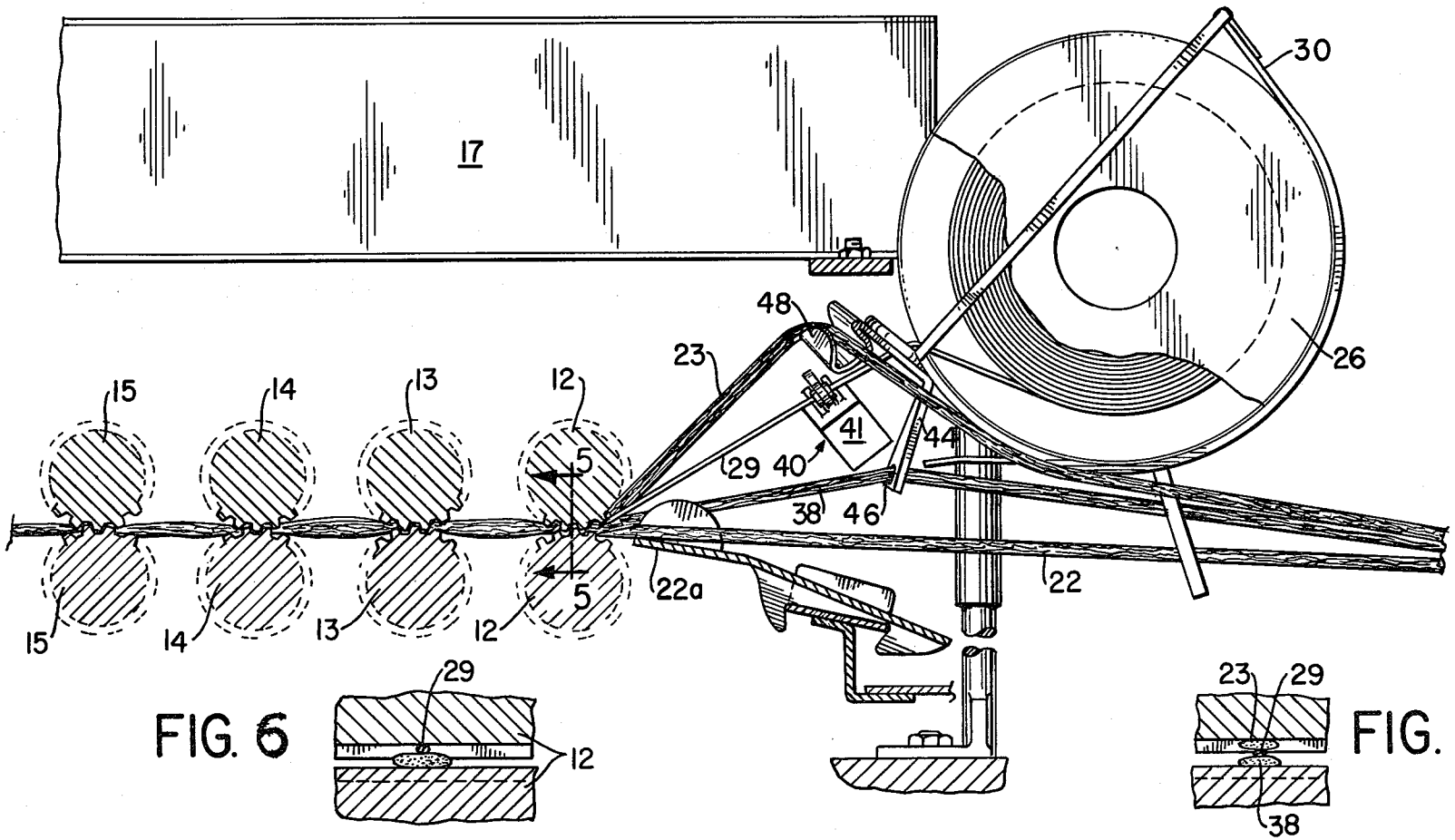
FIG. 4 is an elevational view, partially in cross-section and partially broken away, taken in the directions of the line 4—4 of FIG. 1.
FIG. 5 is a cross-sectional view taken in the direction of the line 5—5 of FIG. 4, illustrating a typical arrangement of textile and metal fibers.
FIG. 6 is a cross-sectional view similar to FIG. 5 illustrating an alternate arrangement of textile and metal fibers.
Figure 7:
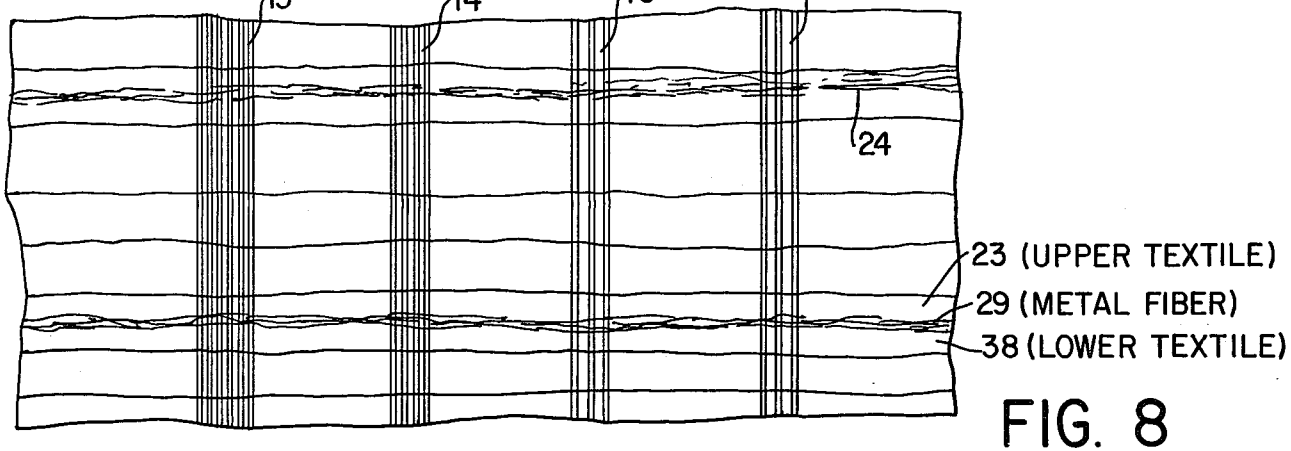
FIG. 7 is a plan view illustrating the even distribution of metal fibers due to the drawing action of the respective drawing rollers.

The fiber point of engagement is best illustrated in FIGS. 3 and 4. The sliver guide 40 defines an opening 46 in a downwardly extending flange 44 which serves to support and guide the textile fiber bundle 38 so that at the point of engagement the textile fiber bundle is directly beneath the metal fiber material bundle 29. Preferably, the sliver guide 40 also possesses a support trough 48 arcuately dimensioned, configured and positioned to support and guide another textile fiber bundle 23 such that at the point of engagement the textile fiber bundle cushions the metal fibers of the metal fiber bundle 29 directly from above the metal fiber bundle. The textile fiber bundle 23 extends alongside downwardly extending flange 44 and passes upwardly through the support trough 48 before turning downwardly towards the point of engagement. In the drawing frame 10, four pairs of rollers 11 will be mounted side-by-side as shown, each set adapted to receive eight slivers comprising, for example, three slivers of cotton and five of polyester fibers. For purposes of clarity, only part of the rollers 11 has been illustrated and only seven textile slivers are shown in FIGS. 1 and 2 being fed into the draw rolls. Six of the textile slivers shown are individually designated as upper slivers 20 through 25 with the textile sliver 38 extending underneath spool support 30. The textile slivers designated by reference numerals 23–25 and 38 may be cotton or other textile slivers (such as NOMEX brand sliver, for example) and the remaining slivers may be polyester (or other) slivers. Any combination of textile slivers may be used, such as cotton, NOMEX, polyester, nylon, polypropylene or the like.

FIG. 5 illustrates the present invention wherein the guiding means utilizes two textile fiber bundles 23 and 38 such that the meshed sliver is drawn through the frame 10 and supports the metal fiber bundle 29 from both above and beneath. It should be noted that another embodiment of the present invention shown in FIG. 6 utilizes the above-described method and apparatus wherein only one textile fiber bundle is employed and thus the metal filamentary material 29 is supported at the point of engagement only from beneath. In addition, it should be noted that any numbers and combinations and positions of textile and metal fiber bundles may be utilized in practicing the present invention.

The systematic unwinding of the spool 26 occurs concurrently with a spool movement laterally along its spool support 30. As previously noted, these movements have been found to obviate the need for an upright spool and tensioning purn as found in the prior art. Thus, the unraveling and tangling of metal fibers or filaments is eliminated or minimized due to the lack of lateral tension among layers of unwinding metal filaments.

Although any conductive fibers may be used (i.e. carbon fibers), a preferred fibrous material is staple length stainless steel sliver or continuous filament stainless steel tow wherein the fibers or filaments are of 4–12 micron diameter. Specifically with regard to non-continuous stainless-steel sliver, the present invention can employ staple length bundles of stainless steel fibers such as those which are manufactured by Bekaert S. A., a Belgian corporation wherein the average length of each staple is approximately, but preferably not greater than, about 10 inches in length. Accordingly, it will be appreciated that where staple length fiber bundles are blended with textile fiber bundles, the positioning of the metal fiber bundle behind the back rollers of the drawing frame a distance approximately equal to, or preferably less than, the length of the staples will cause continuous gripping of the metal fiber bundle by the draw rolls. Guiding of the textile slivers 20, 21, 22, 24 and 25 is provided by guide spoons 20*a*, 21*a*, 22*a*, 24*a*, and 25*a*, respectively positioned immediately adjacent the back rollers of the drawing frame. If desired, and if space permits, a guide spoon (or guide spoons) for textile slivers 23 and 38 may also be positioned adjacent the back rollers of the draw frame at a selected location or at several select locations as the case may be.

Thus, it will be appreciated that the present invention eliminates the problems incident to supporting the metal fiber sliver bundles at two respective locations spaced greater than the average length of the staples. The latter arrangement permitted the tension applied to the metal bundles to literally pull the bundles apart causing disruption of the operation and shedding and loss of metal fibers.

Figure 8:
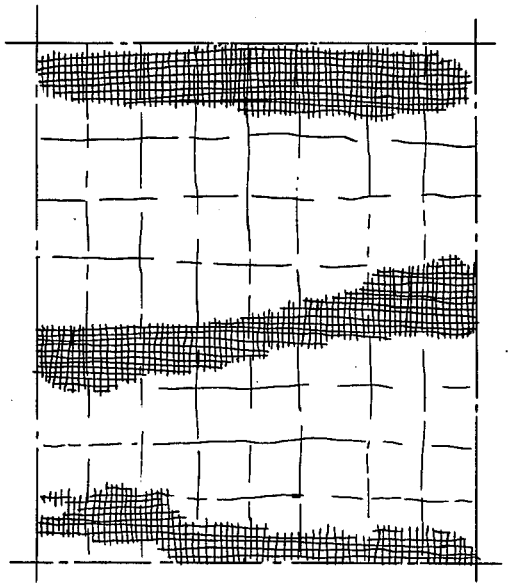
FIG. 8 is a schematic illustration of a woven fabric illustrating a typical distribution of metal fibers in the warp and the filling directions produced by the present invention.

Practice has shown that cotton fibers provide better cushioning effect as the textile fiber than synthetic fibers such as polyester, NOMEX brand, etc. Thus uniform and slub-free blends of synthetic textile fibers having controlled amounts of stainless steel fibers interspersed therethrough are more difficult to achieve. Correspondingly blends of synthetic and cotton fibers having controlled amounts of stainless steel fibers interspersed therethrough are achieved with somewhat less difficulty due to the increased cushioning effect of the cotton slivers. Perhaps the reason for the enhanced cushioning of cotton is that certain restriction (i.e. friction, etc.) characteristics of both cotton and stainless steel are similar. Also, cotton is a natural staple which is not identically duplicated by synthetic fibers. In any event, the juxtaposition of stainless steel and cotton, as shown in FIGS. 5 promotes uniform dispersement of the stainless steel fibers in the final textile yarn and ultimately in the fabric produced therefrom. Moreover, the invention has been proven very effective in preventing slubbing, slubbing being defined as the formation of a group or bundle of metal fibers caused by incomplete separation of the metal fibers of a breaker drawn multi-filament tow or multifiber sliver bundle. The use of such materials causes even distribution of suitable stainless steel fibers throughout the yarn. It has been found that, in general, the formation of slubs using the principle of the present invention is minimal and that only a relatively small number of slubs may be found in any given sample of linear yardage of greige goods. X-ray examination of greige goods produced by the presently disclosed invention (FIG. 8) reveals a combination of fibers wherein there averages no more than about 4 steel fibers per bundle which are invisible to the naked eye. FIG. 8 illustrates a typical distribution of steel filaments (greatly enlarged) in both warp and filling directions.

It should be understood that in pacticing the present invention various changes and modifications may be made without departing from the spirit and scope of the invention as contemplated herein. For example, although the foregoing description refers to textile fibers and conductive or metal fiber bundles, it is forseeable within the scope of the invention to blend all types of fibrous or fiber materials such as, for example, those fiber materials which for some reason, are not characterized as "textile" fibers per se.

We claim:

1. A method of drawing and blending at least two bundles of fibrous materials while maintaining contact with each other comprising:

(a) feeding at least one bundle of a first fibrous material through draw rollers of a drawing frame;
(b) supporting a roll of a bundle of second fibrous material adjacent the rearmost rollers of the drawing frame;
(c) unwinding said roll of said bundle of second fibrous material adjacent said rearmost rollers of the drawing frame;
(d) feeding said second fibrous material bundle into said rearmost rollers of the drawing frame simultaneously with said first fibrous material bundle; and
(e) guiding said first fibrous material bundle and said second fibrous material bundle relative to each other such that the latter is continuously cushioned by said first material bundle with respect to said draw rollers when passing therethrough.

2. A method of drawing and blending textile fiber and conductive fibers while maintaining contact with each other comprising:
(a) feeding at least one bundle of a first textile material through draw rollers of a drawing frame;
(b) supporting at least one roll of a bundle of second fibrous material in the form of conductive fibers substantially immediately adjacent and behind the rearmost rollers of the drawing frame;
(c) unwinding said at least one roll of said bundle of conductive fibers adjacent the rearmost pair of rollers of the drawing frame;
(d) feeding said conductive fiber bundle into said rearmost rollers of the drawing frame simultaneously with said textile material fiber bundle; and
(e) guiding said textile material fiber bundle and said conductive fiber bundle relative to each other such that the latter continuously cushions said textile material fiber bundle with respect to said draw rollers when passing therethrough.

3. The method according to claim 2 wherein said bundle of textile material and bundle of conductive material fibers are fed into a plurality of successive sets of sequentially arranged draw rollers and said metal fiber bundle is guided into the first set of rollers substantially immediately adjacent the first set of rollers.

4. The method according to claim 3 wherein said draw rollers are arranged horizontally, and a plurality of textile fiber bundles and metal fiber bundles are fed to said rollers, said textile bundles being in side by side relationship and each of said metal bundles overlying one of said textile bundles.

5. The method according to claim 4 wherein said textile fiber bundles and metal fiber bundles have similar surface friction characteristics with respect to said draw rollers.

6. The method according to claim 5 wherein said textile fiber bundle is cotton and said metal fiber bundle is stainless steel.

7. The method according to claim 6 wherein said stainless steel is made of metal fibers in the 4 to 12 micron range.

8. The method according to claim 7 wherein the textile fiber bundles after drawing are passed through roving and spinning steps to create yarn.

9. The method according to claim 8 wherein two rolls of metal fiber bundles are unwound and fed into said draw rollers.

10. An improved method of drawing and blending textile fibers and conductive metal fibers while maintaining contact with each other comprising:
(a) feeding at least one bundle of textile fibers into a drawing frame so as to be introduced through the draw rollers of the drawing frame;
(b) supporting at least one roll of a bundle of staple length conductive metal fibers adjacent and behind the rearmost rollers of the drawing frame;
(c) unwinding said at least one roll of said bundle of staple length conductive metal fibers adjacent the rearmost rollers of the drawing frame;
(d) feeding said bundle of staple length metal fibers into the rearmost rollers of the drawing frame substantially simultaneously with said textile fiber bundle;
(e) independently guiding said bundle of textile fibers into the draw rollers of the drawing frame; and
(f) independently guiding said bundle of metal fibers relative to said bundle of textile fibers to cause the latter continuously to cushion said metal fibers with respect to said draw rollers when passing therethrough while controlling the tension force on said metal fibers from the location of unwinding and throughout the drawing process systematically so as to break said metal fibers generally continuously during the period of drawing.

11. An improved method of drawing and blending textile fibers and staple length conductive metal fibers while maintaining contact with each other comprising:
(a) feeding at least one bundle of textile fibers into a drawing frame so as to be introduced through the draw rollers of the drawing frame;
(b) supporting a roll of staple length conductive metal fibers in an arcuately configured supporting container positioned adjacent and behind the rearmost set of rollers of the drawing frame, said staple length being not greater than approximately ten inches;
(c) unwinding said roll of said bundle of staple length conductive metal fibers adjacent said rearmost rollers of the drawing frame at a distance therefrom at least equal to or less than the average length of the metal fiber staples;
(d) feeding said bundle of staple length metal fibers into said rearmost rollers of the drawing frame substantially simultaneously with said textile fiber bundle into the draw rollers of the drawing frame;
(e) independently guiding said bundle of textile fibers relative to said metal fiber support means substantially immediately prior to introduction into the draw rollers of the drawing frame;
(f) independently guiding said bundle of metal fibers relative to said bundle of textile fibers to cause the latter to continuously cushion said metal fibers with respect to said draw rollers when passing therethrough;
(g) applying tension forces to said bundle of metal fibers from the location of unwinding thereof from said roll throughout the drawing process; and
(h) controlling said tension forces on said metal fiber bundle in a manner to cause breakage of metal fibers generally continuously during the period of drawing and resulting in substantially uniform dispersement of metal fibers throughout the textile fibers.

12. An apparatus for supporting at least one spool of a bundle of textile fibrous material and for permitting unwinding of said bundle of fibrous material for introduction into a drawing frame for blending with at least a second fibrous material comprising a drawing frame, a support container having a generally arcuate cross-sectional configuration for nestled reception of the spool therein and positioned so as to permit continuous unwinding of the bundle of fibrous material when tension is applied thereto, means for guiding the bundle of fibrous material adjacent the container so as to guide the fibrous material in a predetermined direction into the rearmost draw rollers of the drawing frame after unwinding from the spool.

13. An apparatus for supporting at least one spool of a bundle of staple length metal fibers and for permitting unwinding of said bundle of metal fibers for introduction into a drawing frame for blending therein with textile material fibers comprising a support container having a generally arcuate cross-sectional configuration sufficiently similar to the cross-section of the support ends of the spool for nestled reception of the spool of metal fibers therein so as to permit continuous unwinding of the bundle of metal fibers when it is continuously drawn into the rearmost rollers of the drawing frame, means extending from said support container for guiding the bundle of metal fibers in a predetermined direction substantially immediately after unwinding from the spool and in a manner to cause the metal fibers and textile fibers to be brought initially in contact with each other without twisting of said textile bundle or envelopment of said metal bundle of said textile bundle immediately prior to passing through the rearmost rollers of the drawing frame, switching means to detect the tension forces applied to the bundle of metal fibers when the bundle of metal fibers is drawn into the drawing frame, and to deactivate the drawing process in the event the bundle of metal fibers is broken.

14. An apparatus for simultaneously drawing bundles of textile fibers and metal fibers comprising a frame, at least a first and second pair of drawing rollers mounted on said frame for rotation, means for supporting at least one spool of a bundle of staple length metal fibers rolled thereabout and for permitting unwinding of said bundle of metal fibers for introduction into said drawing rollers for blending therein with the textile fibers, said supporting means comprising a support container having a generally arcuate cross-sectional configuration sufficiently similar to the cross-section of the support ends of the spool for nestled reception therein so as to permit continuous unwinding of the bundle of metal fibers when it is continuously drawn into the first pair of rollers of the drawing frame, said support container having an inner arcuate surface which provides sufficient rotational resistance to said spool of metal fibers to permit the application of a tension force to said bundle of metal fibers when drawn into said first pair of draw rollers to cause breakage of metal fibers, means for guiding the bundle of textile fibers into said drawing rollers, means secured to, and extending from said support container for guiding the bundle of metal fibers in a predetermined direction relative to said bundle of textile fibers and in a manner to cause the metal fibers and textile fibers to be brought initially in contact with each other without twisting of said bundle of textile fibers or envelopment of said bundle of metal fibers by said bundle of textile fibers immediately prior to passing through the first pair of rollers of the drawing frame, switching means to detect the tension forces applied to the textile fiber bundle when the bundle is drawn into the drawing frame, and to deactivate the drawing process in the event the bundle of metal fibers is broken.

15. The apparatus of claim 13 wherein several pairs of draw rollers are arranged sequentially.

16. The apparatus of claim 15 wherein four pairs of rollers gear-toothed type rollers are arranged sequentially.

17. The apparatus of claim 16 wherein said spool supporting means is positioned behind the rearmost pair of rollers a distance approximately equal to or less than the average length of the metal fiber staples so as to insure continuous gripping of said metal fibers by said first pair of rollers.

18. A method of drawing and blending at least two bundles of fibrous materials while maintaining contact with each other comprising:

(a) feeding at least one bundle of a first fibrous material into a drawing frame having a plurality of sequentially arranged pairs of draw rollers for drawing;

(b) supporting a roll of a bundle of second fibrous material in supporting means having a generally arcuate configuration and positioned adjacent and behind the rearmost rollers of the drawing frame;

(c) unwinding said roll of said bundle of second fibrous material adjacent said rearmost rollers of the drawing frame;

(d) feeding said second fibrous material bundle into said rearmost rollers of the drawing frame simultaneously with said first fibrous material bundle; and (e) guiding said first fibrous material bundle and said second fibrous material bundle relative to each other such that the latter continuously cushions said first material bundle with respect to said draw rollers when passing therethrough.

* * * * *

UNITED STATES PATENT AND TRADEMARK OFFICE

CERTIFICATE OF CORRECTION

PATENT NO. : 4,369,622

DATED : January 25, 1983

INVENTOR(S) : Richard K. Teed et al.

It is certified that error appears in the above-identified patent and that said Letters Patent are hereby corrected as shown below:

Column 11, line 27,

"of said textile"

should read:

--by said textile--.

Signed and Sealed this

Nineteenth Day of April 1983

[SEAL]

*Attest:*

GERALD J. MOSSINGHOFF

*Attesting Officer*

*Commissioner of Patents and Trademarks*